United States Patent [19]

Fleckenstein

[11] 4,188,046

[45] Feb. 12, 1980

[54] SKI AND INTEGRAL BOOT PLATE WITH TOE PIECE AND RELEASABLE HEEL BINDING

[76] Inventor: John Fleckenstein, 20580 Enterprize Ave., Brookfield, Wis. 53005

[21] Appl. No.: 897,587

[22] Filed: Apr. 19, 1978

[51] Int. Cl.[2] ..... A63C 9/08

[52] U.S. Cl. ..... 280/618; 280/636

[58] Field of Search ..... 280/600, 601, 618, 607, 280/633, 636, 610, 87.04 A

[56] References Cited

U.S. PATENT DOCUMENTS

| | | | |
|---|---|---|---|
| 3,153,543 | 10/1964 | Magyar | 280/87.04 A |
| 3,771,805 | 11/1973 | Ishida | 280/610 |
| 3,971,567 | 7/1976 | Sittmann | 280/618 |
| 4,007,946 | 2/1977 | Sarver | 280/600 |

FOREIGN PATENT DOCUMENTS

| | | | |
|---|---|---|---|
| 2612145 | 9/1977 | Fed. Rep. of Germany | 280/600 |
| 1248744 | 11/1960 | France | 280/600 |

*Primary Examiner*—Richard A. Bertsch
*Assistant Examiner*—Gene A. Church

[57] ABSTRACT

The invention relates to a ski of the type for so-called "hot dogging", or fancy skiing on snow and comprises a relatively short ski, preferably made from a suitable plastic material such as a polycarbonate like Lexan and in a clear color. An important element of this ski is the utilization of a boot plate integral with the runner, with a toe piece adjustably mounted with the plate and a manually releasable heel clamp mounted adjacent the rear of the plate having multiple adjustments for proper fitting to a particular ski boot size.

1 Claim, 8 Drawing Figures

SKI AND INTEGRAL BOOT PLATE WITH TOE PIECE AND RELEASABLE HEEL BINDING

BACKGROUND OF THE INVENTION

Heretofore, short skis have been available in the prior art but all of these skis utilized automatically releasable boot bindings, using a separate boot plate and in many instances other separate pieces. The great majority of prior skis were of full length which, in some models, may have been on the order of seven feet (7'), or more, and which were not particularly suited to the type of skiing contemplated for the present type of ski. Such skis necessitated the automatic release of the boot bindings in the event of mishap in order to prevent, if possible, serious injury to the skiers ankles, legs, or otherwise.

Short skis have been available in the prior art but these give the impression of training skis, or skis intended for children. Some such short skis were long enough to include a flexible forward portion of the runner in front of where the boot mounted on the ski. Other skis of this type amounted to nothing more than a flat board, or plate, with an upturned toe portion and some included depending side runners. At least one such short type of ski included lines attached to the toe portions of the skis allegedly for "steering" the skis. It follows that experienced, or expert skiers would not be inclined to use such skis which might be considered "gimmicks" for the inexperienced.

SUMMARY OF THE INVENTION

The present invention provides a short ski designed for the skilled skier and which might be utilized as a practice ski, as well as for fancy skiing and it is proposed that this improved ski shall bend more than about twenty inches (20") in total length, or thereabout.

The ski is characterized especially by its integral structure including a boot plate integral with the ski runner and an upstanding toe piece adjustable on the boot plate adjacent the front of the ski in position to engage and clamp to a ski boot on the plate. A special heel clamping arrangement also comprises an important element of the ski and includes a flexible cable pivotally secured in the rear portion of the boot plate with a boot clamp pivotally mounted intermediate the ends of the cable.

This heel clamp engages the heel portion of the ski boot and is locked by turning it past dead center, as represented by its pivotal mount on the cable. In this position it exerts both a downward pressure on the heel of the boot and a forward pressure to urge the boot into the toe piece.

The length of the cable is adjustable by means of threaded buckles on the opposite ends of the cable and which screw onto fastening members pivotally mounted in the rear portion of the boot plate, which enable the ski to be adapted to different boots of various sizes.

The heel clamp also incorporates an important adjustment in the form of a screw plug threaded into the clamp adapted to be screwed into the pivotal clamp from the rear and passing therethrough to engage the heel of the boot and depending upon the adjustment, adapted to vary the over center release point of the clamp whereby the ski and clamping arrangement are easily adapted to various size ski boots.

This screw plug adjustment is so located as to avoid interference with the "forward lean adjustment" device utilized by many skiers which extends from the lower part of the skiers calf to behind the ankle.

This ski is not automatically releasable under any circumstances, but must be released manually by pivoting the heel clamp over dead center to release the clamping action. In the event of a severe fall a skier using this equipment will not injure a leg, or be hurt otherwise, because the ski is of a size that it can be worn under such circumstances without incurring the damaging forces encountered where conventional full length skis are worn.

This ski, because of its short length and integral construction is particularly adapted to use in trick skiing and is curved upwardly at both front and rear ends of the runner on similar radii, further to enhance its utilization in this type of skiing. In fact, the ski is balanced as to the front and rear extension thereof in relation to the boot plate and boot position on the ski, whereby the front and rear overhang can be about equal.

OBJECTS OF THE INVENTION

The primary purpose of the invention is realized in a relatively short ski, of balanced design, having an integral boot plate and runner, an adjustable toe piece and with a heel clamping arrangement affording adjustment for the over center release point of the heel clamp.

The principal object of the invention is the provision of a short ski of approximately twenty inches (20") in maximum length particularly designed for trick skiing.

An important object of this invention is to provide a ski for trick skiing and the like, having an integrally constructed footplate and an adjustable toe piece with an upstanding boot clamping portion, whereby all of these elements in effect comprise one assembly with the ski runner.

Another object of the invention is the provision of a short ski of integral construction having a heel clamping arrangement including a pivotal heel clamp on an adjustable cable and incorporating an adjustment member engageable with a boot heel portion to determine the over center release position of the heel clamp.

A further object of the invention is to provide a short ski for trick skiing having a heel clamping arrangement which exerts a downward and a forward force having turnbuckle adjustments for fitting the clamping arrangement to a particular boot size and a separate adjustment for determining the overcenter release point for a heel clamp member so located as not to interfere with other ski elements.

DESCRIPTION OF THE DRAWINGS

The foregoing and other and more specific objects of the invention are attained by the ski structure and arrangement illustrated in the accompanying drawings wherein.

DESCRIPTION OF PREFERRED EMBODIMENT

Figure 1:
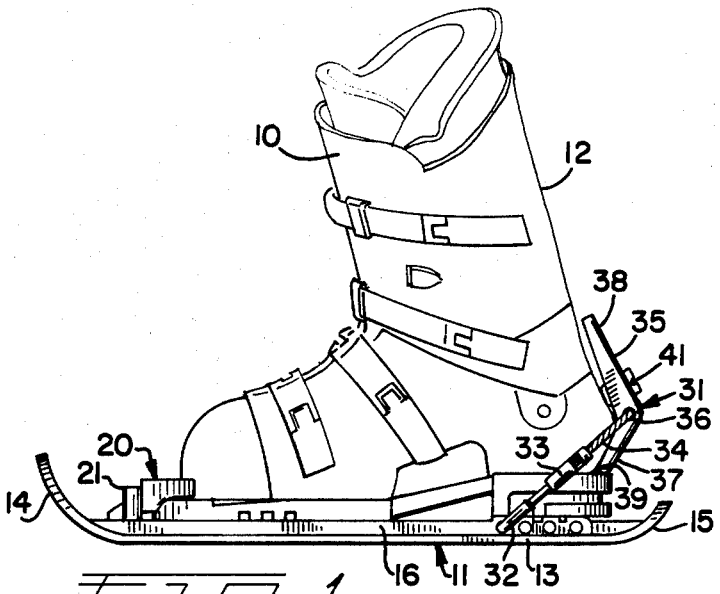
FIG. 1 is a general view of this ski arrangement in relation to a ski boot with the heel clamp indicated in broken lines in the intermediate position ready to be locked against the boot heel or swung to fully released position.
Figure 8:
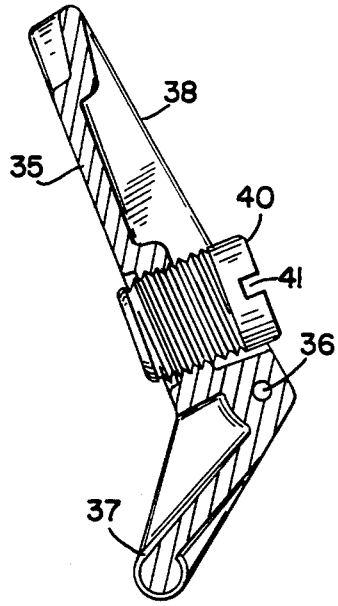
FIG. 8 is a detail vertical sectional view through the heel clamp member showing the screw threaded adjustment plug extending through the clamp member.
Figure 7:
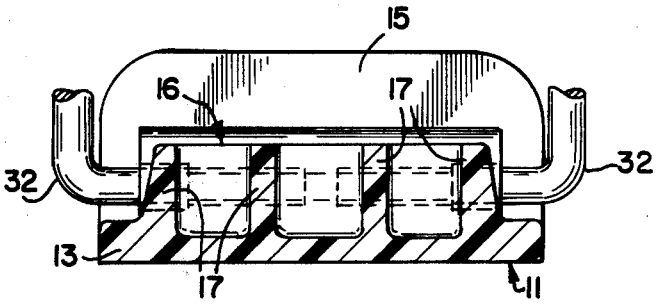
FIG. 7 also in a cross-sectional view through the ski taken on the line 7–7 of FIG. 2.
Figure 4:
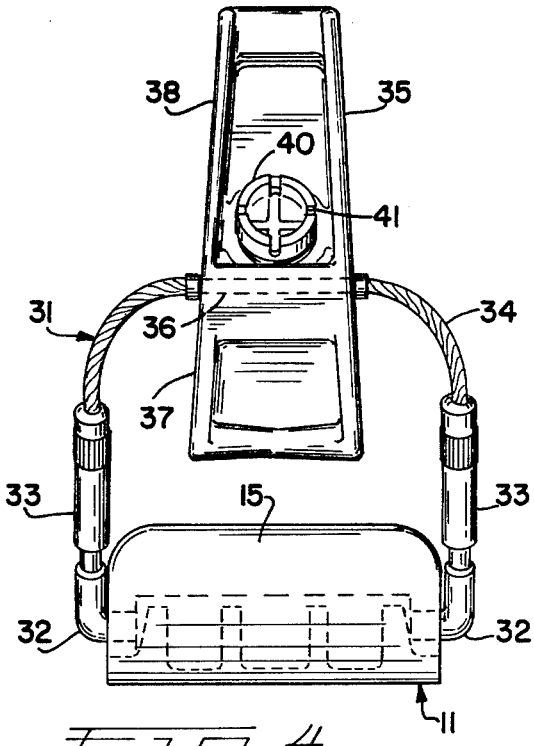
FIG. 4 is a rear elevational view of the ski and heel clamp.
Figure 5:
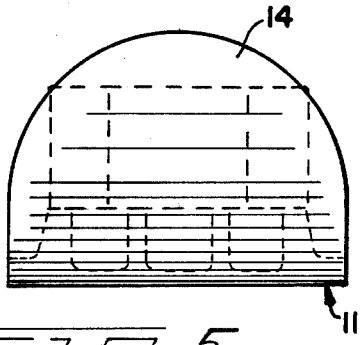
FIG. 5 is a front elevational view of the ski.

In the drawings as shown in FIG. 1, a typical ski boot 10 is illustrated in association with the ski 11 of this invention and this boot has a "forward lean" feature built in, as distinguished from an adjustment for this feature incorporated in many currently marketed This forward lean feature is readily recognized in the drawing by the angle of the boot indicated at the rear of the boot, as at 12, which angle is built into the structure of the boot so that a skier wearing boots of this type must assume the semi-crouched position normal to proper skiing technique.

The ski 11 is made from a suitable plastic material and a polycarbonate such as Lexan, has been found to be highly satisfactory. The ski preferably is molded from such material in a clear color, although colors, or tints, might be added if considered desirable. The ski includes a runner 13 which, as shown, is provided with a smooth, flat bottom surface and upwardly curved integrally formed front and rear end portions 14 and 15. These upwardly extending portions 14 and 15 can be curved on similar radii and it will be seen that the curved front portion 14 extends upwardly to a higher extent than the rear extension 15. This has been found to be desirable during forward progress on the ski, especially in fresh snow, or powder and particularly when skiing downhill.

Figures 2, 3, 6:
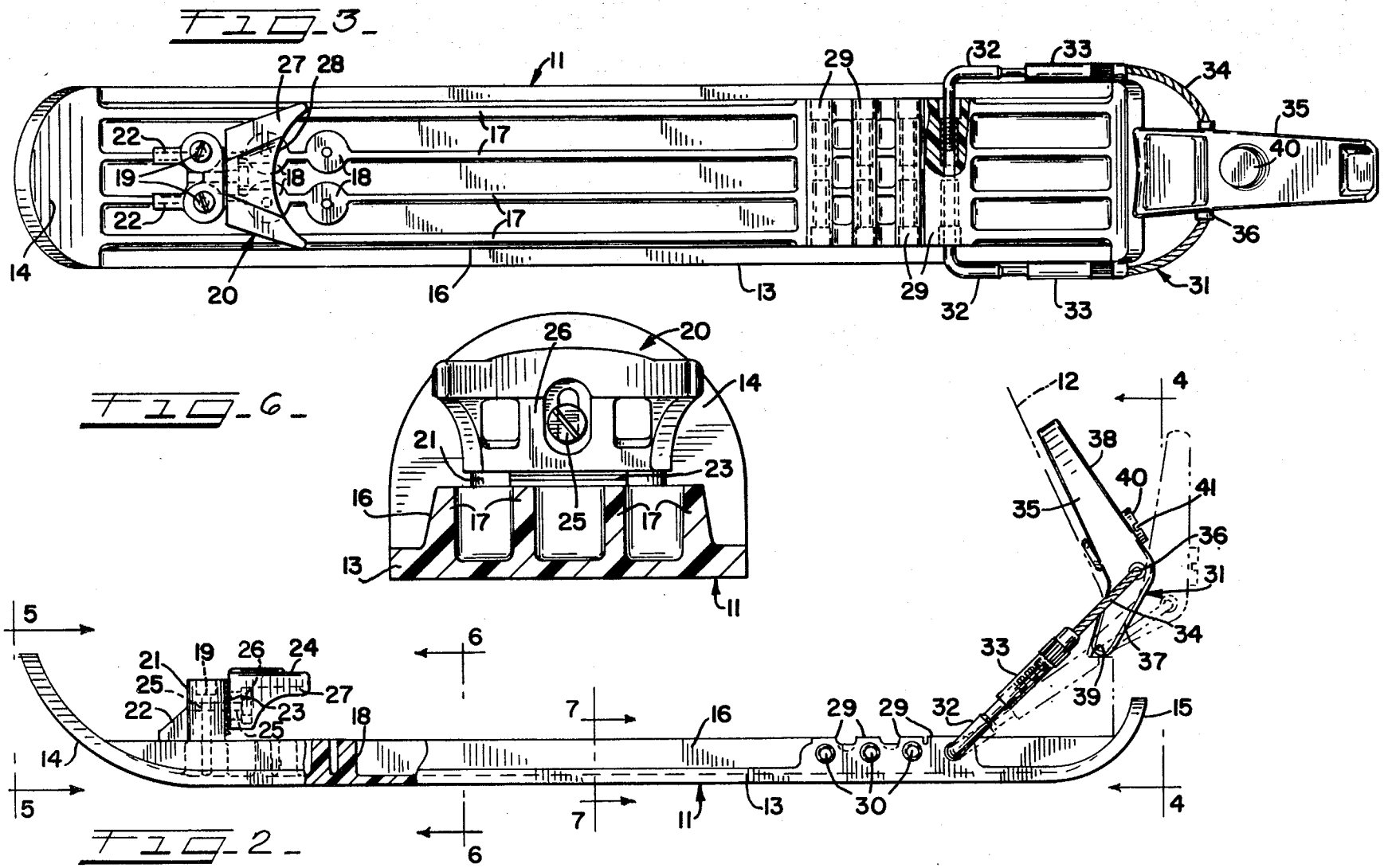
FIG. 2 is a side elevational view of the ski with the heel of the boot indicated and the heel clamp in fully locked position against the heel.
FIG. 3 is a top plan view of the ski.
FIG. 6 is a cross-sectional view through the ski taken on the line 6—6 of FIG. 2.

The ski is formed with a platform, or boot plate 16, molded integrally with the runner element 13 and which includes a plurality of longitudinally extending, integral ribs 17 disposed full length between the front and rear upturned portions 14 and 15. Adjacent to the front portions of the ribs, the intermediate ribs are provided with a plurality of pairs of equally spaced enlargements, or bosses 18, as best shown in FIGS. 2 and 3. These bosses 18 have vertically disposed central openings which are threaded to receive vertical bolts, or screws 19. The screws 19 fasten an adjustable toe piece assembly 20 on the boot plate and may be driven into any pair of the longitudinally spaced holes in the bosses 18, depending upon the adjusted position of the toe piece assembly relative to a particular sized boot.

The toe piece assembly includes an upstanding block 21 containing vertical holes for the screws 19 and adapted to seat on the middle ribs 17 and the bosses 18, where it is secured in any one of the selected positions on a pair of such bosses and secured thereby by the screws 19. Forwardly extending gussets 22 also bear on the central pair of ribs 17 and act to reinforce and brace the toe piece assembly against forwardly directed forces. The rear face of the block 21 is serreted, as at 23 (see FIG. 2), and a toe clamp piece 24 is similarly serreted on its front face, which is disposed in opposed relation to the serreted face 23 and secured by a bolt 25, disposed horizontally and which extends through the vertical wall 26 of the toe clamp 24 and threaded into the vertical block 21 to bring the serreted faces into tight engagement. The opening through the wall 26 for the bolt 25 is vertically slotted so that the toe piece 24 can be adjusted vertically on the block where it is retained by the engagement of the serrations 23. The toe piece also includes a generally horizontally disposed boot clamping flange 27 which has a concavely curved front edge 28 facing the boot 10 so as to fit the rounded toe of the boot and which is adapted to engage the sole of the boot to cause the boot to be clamped to the boot plate 16 at its front, or toe position.

Adjacent to the rear portion of the runner 13, the longitudinal ribs 17 are traversed by four intersecting ribs 29 extending transversely of the longitudinal ribs and which are provided with threaded openings 30 extending entirely through the ribs 29. These threaded holes 30 provide variable anchor pivot points for a boot heel anchor assembly 31. As parts of such assembly, angle shaped members 32 are threaded into opposite ends of a selected hole 30 adapted to fit a boot size, shown in FIG. 1 as a relatively short boot since the angle members 32 are mounted in the forward most hole 30. The free end of each of these angle members 32 is also threaded and a buckle member 33 is threaded onto each angle member. The buckle members 33 are rotatably mounted on opposite ends of a flexible cable 34, the buckles 33 affording a means of adjusting the length of the cable in accordance with the size of the ski boot 10. The cable 34 extends through a heel clamp member 35, as at 36, which represents the pivot mounting point for the heel clamp 35. The buckles 33 may be adjusted by turning them on the threads of the angle shaped anchor pivot members 32, thus shortening, or lengthening the cable 34 in accordance with the boot size.

The heel anchor member 35 includes boot heel engaging lower portion 37 below the pivot point 36 and a generally upwardly extending free end portion 38 above this pivot point. Looking at FIG. 2, particularly the broken line illustration, it will be seen that the bottom end of the lower portion 37 of the heel clamp is first engaged over the sole of the ski boot at the juncture point 39 of the heel with the boot upper and with the cable 34 properly adjusted by means of turn buckles 33, is then fulcrumed about the pivot point 36 on the cable, which is pivotally anchored at 30 in the boot plate 16 on the ski runner 13, so that the clamp 36 exerts a downward thrust on the ski boot as well as a forward thrust to cause the boot to engage more securely under the toe clamp 24. The heel clamp member 35 fulcrums about the three points 30, 36 and 39 to the fully clamped position against the boot heel as shown in the full line position indicated in both FIGS. 1 and 2.

An adjustment plug 40 is threaded entirely through the heel anchor member 35 above the pivot point 36 represented by the cable 34 and is adapted to engage the rear portion of the ski boot heel when the member 35 is in fully clamped position. In this position the clamp member is disposed in an over-center position with respect to a line passing through the three points 30, 36 and 39 so that when the line passes beyond the point 39 the force between the points 30 and 36 is beyond dead center and the clamp member 35 tends to snap to the fully clamped position against the boot heel.

Many ski boots include a forward lean adjustment arrangement which usually extends from the lower part of the skiers calf to a position behind the ankle. The adjustment plug 40 is so located as to avoid interference with any such arrangement. The adjustment plug 40 enables the over-center release point of the clamp 35 to be varied in accordance with ski boots of various sizes and may be adjusted merely by inserting a coin, or the like, in the slot 41 and rotating the plug through the threaded opening provided in the clamp portion 38 until the adjustment is attained as desired by the skier.

From the foregoing it will be seen that there has been provided an integrally molded ski of a polycarbonate, having a boot plate as an integral part of the ski runner structure with a toe piece assembly adjustable longitudinally on the boot plate and adjustable vertically as well, together with an adjustable heel clamp arrangement comprised of a fulcrumed clamp having an over-center adjustment and pivotally mounted relative to the boot plate by an adjustable cable having pivotal mounting in the boot plate and in the clamp member.

What is claimed is:

1. A ski for specialty skiing comprising a runner having a maximum length of about 20" and having a front tip curved upwardly on a radius, a boot plate formed integrally with said runner including a plurality of upstanding lengthwise ribs on the runner, an upstanding toe piece mounted on the boot plate, a heel anchor device pivotally secured in the rear portion of said boot plate, said anchor device including a flexible cable having a pivot mounting device in the boot plate, an anchor member pivotally mounted in the cable, said cable having turn buckles respectively connecting the opposite ends thereof with said pivot mounting device, said pivot mounting device being threaded into the boot plate, a plurality of longitudinally spaced threaded openings into the opposite sides of the boot plate to receive the pivot mounting device, said pivot mounting device including a pair of angle shaped members entering said boot plate from opposite sides thereof and each having threads for engagement by said turn buckles and threads for engagement in the boot plate disposed respectively on right angled portions of the angle shaped members, said toe piece being separate from said boot plate and adjustably mounted on said lengthwise ribs, said toe piece including a toe binding piece and a toe block piece having an upstanding portion containing a plurality of vertical openings, vertical fastening members extending through said openings threaded into said boot plate, and a plurality of longitudinally spaced threaded openings formed in enlargements of said ribs affording a plurality of longitudinally adjusted positions to receive said fastening members.

* * * * *